US006536092B2

(12) United States Patent
Nakayama

(10) Patent No.: US 6,536,092 B2
(45) Date of Patent: Mar. 25, 2003

(54) PLASTIC PROCESSING METHOD OF METAL ROD MATERIAL

(76) Inventor: Shinichiro Nakayama, 851, Toya, Tsukui-machi, Tsukui-gun, Kanagawa-ken (JP)

( * ) Notice: Subject to any disclaimer, the term of this patent is extended or adjusted under 35 U.S.C. 154(b) by 0 days.

(21) Appl. No.: 09/897,410

(22) Filed: Jul. 3, 2001

(65) Prior Publication Data

US 2002/0005055 A1 Jan. 17, 2002

(30) Foreign Application Priority Data

Jul. 4, 2000 (JP) ..... 2000-201740

(51) Int. Cl.[7] ..... B23P 13/04

(52) U.S. Cl. ..... 29/558; 29/557; 29/559; 72/220

(58) Field of Search ..... 29/558, 559, 557, 29/DIG. 32; 72/220

(56) References Cited

U.S. PATENT DOCUMENTS

| | | | | | |
|---|---|---|---|---|---|
| 1,599,059 | A | * | 9/1926 | Morton | 606/223 |
| 3,439,400 | A | * | 4/1969 | Brownyer | 29/896.91 |
| 3,439,413 | A | * | 4/1969 | Stillwagon, Jr. | 29/558 |
| 3,792,602 | A | | 2/1974 | Fukuda | 72/220 |
| 3,811,308 | A | * | 5/1974 | Marcovitch | 72/210 |
| 3,893,353 | A | * | 7/1975 | Lahmeyer | 76/108.6 |
| 4,041,750 | A | * | 8/1977 | Moore | 72/187 |
| 4,483,168 | A | | 11/1984 | Sherman | 72/220 |
| 4,561,445 | A | * | 12/1985 | Berke et al. | 600/372 |
| 4,785,868 | A | * | 11/1988 | Koenig, Jr. | 163/5 |
| 5,057,401 | A | * | 10/1991 | Borysko et al. | 430/320 |
| 5,155,943 | A | * | 10/1992 | Matsutani et al. | 451/28 |
| 5,178,628 | A | * | 1/1993 | Otsuka et al. | 606/223 |
| 5,263,974 | A | * | 11/1993 | Matsutani et al. | 606/223 |
| 5,477,604 | A | * | 12/1995 | Smith et al. | 29/558 |
| 5,539,973 | A | * | 7/1996 | Smith et al. | 29/558 |
| 5,630,268 | A | * | 5/1997 | Smith et al. | 29/557 |
| 5,661,893 | A | * | 9/1997 | Smith et al. | 29/558 |
| 5,673,581 | A | | 10/1997 | Segal | 72/184 |
| 6,018,860 | A | * | 2/2000 | Smith et al. | 29/558 |

* cited by examiner

*Primary Examiner*—Gregory M. Vidovich
*Assistant Examiner*—Essama Omgba
(74) *Attorney, Agent, or Firm*—Paul A. Guss

(57) ABSTRACT

There is disclosed a plastic processing method for easily shaping a tip end of a metal rod material such that a sectional area of the tip end gradually decreases. A metal rod material 3 is contained in a molding groove 2 which is disposed in a mold 1 and whose end 2*a* has a sectional area smaller than that of the metal rod material 3. Then, a rolling roller 4 is rolled in contact with a mold surface 1*a*, and the rod material 3 is plastically deformed and molded along a shape of the molding groove 2. Subsequently, a burr 3*b* is removed. The molding groove 2 has a sectional area smaller than that of the metal rod material 3 on a tip end 2*a* side, and in addition has a width and depth larger in size than a diameter of the rod material 3 on a rear end 2*b* side, while having a gradually decreasing sectional area on the tip end 2*a* side. A rolling roller 14 rotates together with large-diameter rollers 15*a*, 15*b*, and is pressed in contact with the mold surface 1*a* by the rollers 15*a*, 15*b*. A rolling roller 16 rotates together with a large-diameter roller 17, and a plurality of rolling rollers are supported by a retainer ring 18 disposed coaxially with the roller 17 in an outer periphery of the roller 17, arranged in a planetary shape, and pressed in contact with the mold surface 1*a* by the roller 17.

7 Claims, 9 Drawing Sheets

PLASTIC PROCESSING METHOD OF METAL ROD MATERIAL

BACKGROUND OF THE INVENTION i) Field of the Invention

The present invention relates to a plastic processing method for subjecting a tip end of a metal rod material to a processing for gradually reducing a sectional area of the metal rod material.

ii) Description of Related Art

Examples of a product processed such that a sectional area of a metal rod material gradually decreases toward a tip end of the material include a minus driver, a drill such as a triangular drill, and the like.

As a conventional method for processing the tip end of the minus driver, a method shown in FIG. 12 is known. According to the method, first as shown in FIG. 12A a metal rod material 3 as a raw material is cut to a desired length, and next as shown in FIG. 12B a tip end 21 is press molded to be flat. After the press molding, as shown in FIGS. 12C, 12D, side surfaces 21*a*, 21*b* of the tip end 21 and a tip end shape 22 are ground in order, and a shape of the minus driver is formed. Subsequently, a burr generated during the grinding is removed by barrel grinding or the like, and the material is chamfered, so that a minus driver 6 is obtained as shown in FIG. 12E. In the minus driver 6 shown in FIG. 12E, by the aforementioned processing, the tip end of the metal rod material 3 has a flat and tapered tip end shape 5*a* whose sectional area gradually decreases.

Moreover, as a conventional method for processing the tip end of the triangular drill, a method shown in perspective and surface views of FIG. 13 is known. According to the method, first as shown in FIG. 13A the metal rod material 3 as the raw material is cut to the desired length. Subsequently, as shown in FIG. 13B the tip end is ground to form a conical tip end 23, and next as shown in FIG. 13C the conical tip end 23 is press molded to form a triangular pyramid tip end 24 of the material. After the press molding, as shown in FIGS. 13D, 13E, first, second and third surfaces 24*a*, 24*b*, 24*c* of the triangular pyramid tip end 24 are ground in order, and a tip end shape of the triangular drill is formed. Subsequently, the burr generated during cutting is removed by electrolytic grinding, chemical grinding, and the like, and a cutting edge is used, so that a triangular drill 13 is obtained as shown in FIG. 13F. In the triangular drill 13 shown in FIG. 13F, by the aforementioned processing, the tip end of the metal rod material 3 has a sharp triangular pyramid tip end shape 5*b* whose sectional area gradually decreases.

However, according to the conventional processing methods, a large number of steps are required until the tip ends of the minus driver 6 and triangular drill 13 are shaped. Therefore, the methods are disadvantageously intricate.

SUMMARY OF THE INVENTION

The present invention has been developed to solve the aforementioned problem, and an object thereof is to provide a plastic processing method for easily shaping a tip end of a metal rod material whose sectional area gradually decreases.

To achieve the object, according to the present invention, there is provided a plastic processing method of a metal rod material, comprising the steps of: containing the rod material in a molding groove which is disposed in a mold for molding the metal rod material and which has at least one end having a sectional area smaller than the sectional area of the rod material along a longitudinal direction of the rod material; pressing a rolling roller in contact with a mold surface having the molding groove, rolling/moving the rolling roller toward the end having the sectional area smaller than the sectional area of the rod material from the other end of the molding groove, and plastically deforming and molding the rod material along a shape of the molding groove by the rolling roller; and removing a burr formed of an excess material extruded out of the molding groove by the rolling roller during the plastic deformation.

According to the plastic processing method of the present invention, first the metal rod material as a raw material is contained in the molding groove of the mold. Any metal rod material can be used as long as the material has plasticity, but materials having no plasticity such as a cast material, sintered material and hardened material are inappropriate.

Subsequently, the rolling roller is pressed in contact with the surface of the mold in which the metal rod material is contained in the molding groove, and rolled/moved toward the end having a sectional area smaller than that of the rod material from the other end of the molding groove. Then, with movement of the rolling roller, the metal rod material is pressed onto the molding groove by the rolling roller, plastically deformed along the molding groove, and molded in accordance with the shape of the molding groove.

In this case, the sectional area of the molding groove is smaller than the sectional area of the metal rod material in at least one end along the longitudinal direction of the metal rod material. Then, the excess material of the metal rod material overflowing from the molding groove is extruded out of the molding groove by the rolling roller, and rolled between the mold and the rolling roller, and a foil-shaped burr is formed.

Subsequent to the plastic deformation, the burr is removed, and the metal rod material having the tip end shaped along the molding groove can be obtained. To remove the burr, barrel grinding is suitable when the tip end of the material shaped along the molding groove needs to be chamfered. Moreover, when a cutting edge needs to be used for the tip end, electrolytic grinding, chemical grinding, and the like are suitable for removing the burr.

According to a plastic deforming method of the present invention, by a simple operation of containing the metal rod material in the molding groove disposed in the mold and pressing and rolling the rolling roller on the surface of the mold, the tip end of the metal rod material can obtain the shape whose sectional area gradually decreases. Therefore, the metal rod material having the tip end shaped as described above can easily be molded.

According to the plastic deforming method of the present invention, the molding groove has a sectional area smaller than the sectional area of the rod material on a tip-end side along the longitudinal direction of the rod material, has a width and depth larger in size than a diameter of the rod material on a rear-end side, and has a sectional area gradually decreasing toward the tip end thereof on the tip-end side. In a portion having the width and depth larger in size than the diameter of the metal rod material on the rear-end side of the molding groove, the metal rod material is completely contained in the molding groove. Moreover, when the rolling roller is pressed and rolled onto the mold surface in a portion having the sectional area smaller than the sectional area of the metal rod material on the tip-end side of the molding groove, the rod material can plastically be processed without any difficulty. Therefore, a mold damage, particularly a damage of the molding groove can be prevented. Moreover, since the sectional area of the molding groove gradually decreases toward the tip end on the tip-end side, the metal rod material can smoothly and plastically be deformed along the molding groove.

In the plastic deforming method of the present invention, the rolling roller is rotated together with a roller having a diameter larger than a diameter of the rolling roller, pressed in contact with the mold surface by the large-diameter roller, and therefore protected by the large-diameter roller and prevented from being damaged.

Moreover, the rolling roller rotates together with the large-diameter roller, and a plurality of rolling rollers are supported by a retainer ring disposed coaxially with the large-diameter roller in an outer periphery of the large-diameter roller, and arranged in a planetary shape. Therefore, even in this case, when the rolling roller is pressed in contact with the mold surface by the large-diameter roller, an action/effect similar to the aforementioned action/effect can be attained.

In the plastic deforming method of the present invention, when the mold has a relatively small sectional area decrease ratio, a large-diameter rolling roller is used. Moreover, in a mold whose sectional area decrease ratio is relatively large or which has zero section, a small-diameter rolling roller is used.

DETAILED DESCRIPTION OF THE PREFERRED EMBODIMENTS

Embodiments of the present invention will next be described in detail with reference to the accompanying drawings.

Figure 1:
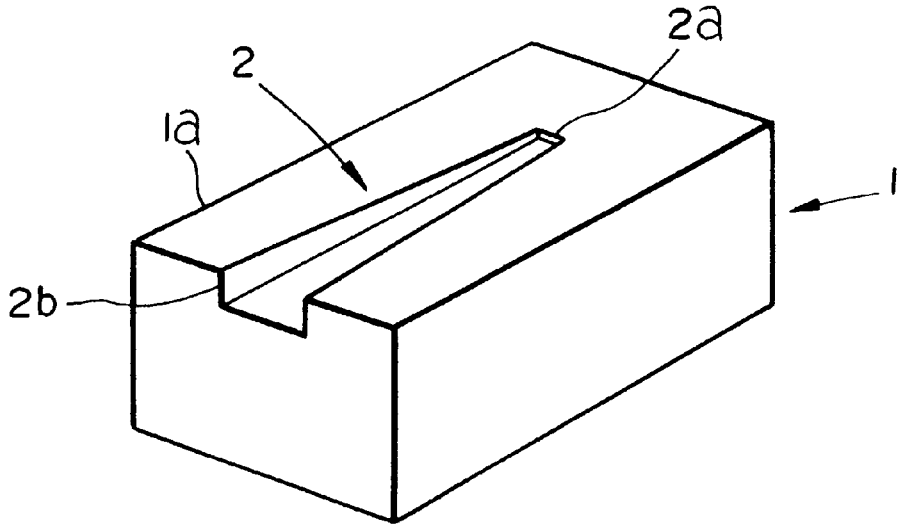
FIG. 1 is a perspective view of a mold for use in a plastic processing method according to a first embodiment of the present invention.
Figure 2:
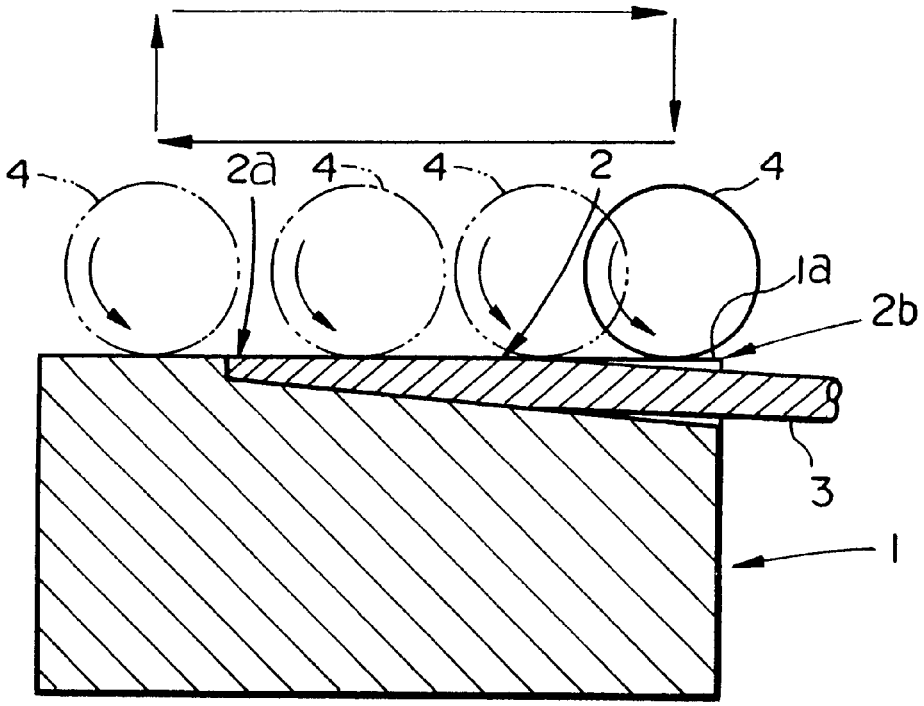
FIG. 2 is an explanatory sectional view showing the plastic processing method of the first embodiment.

An object of a first embodiment of the present invention is to mold a metal rod material into a minus driver. As shown in FIGS. 1 and 2, a mold 1 for use in the first embodiment has a quadratic prism molding groove 2. A sectional area of a tip end 2*a* of the molding groove 2 is smaller than the sectional area of a metal rod material 3, and a rear end 2*b* of the groove has a width and depth larger in size than the diameter of the metal rod material 3. Moreover, the molding groove 2 has a sectional area gradually decreasing toward the tip end 2*a* from the rear end 2*b* thereof.

In the first embodiment, as shown in FIG. 2, first the metal rod material 3 is contained in the molding groove 2, and a rolling roller 4 is pressed onto a mold surface 1*a*. Moreover, when the rolling roller 4 is pressed in contact with the mold surface 1*a*, the rolling roller 4 is rolled toward a tip end 2*a* side from a rear end 2*b* side of the molding groove as shown by arrows of FIG. 2.

Figure 3A:
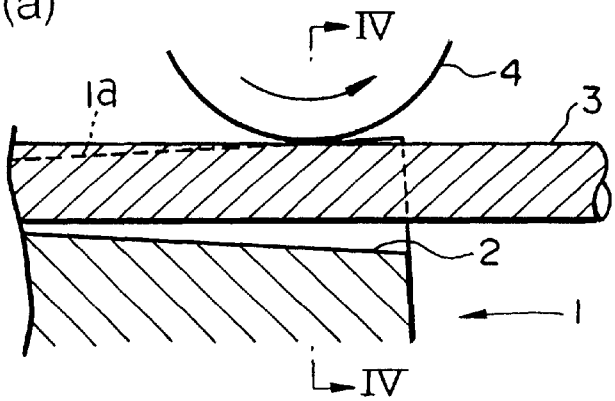
FIG. 3 is an explanatory sectional view showing the plastic processing method of the first embodiment.
Figure 4:
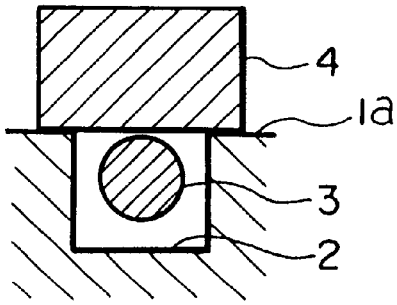
FIG. 4 is a sectional view taken along line IV—IV of FIG. 3.

In this case, in the rear end 2*b* of the molding groove 2 shown in FIGS. 3A and 4A, the molding groove 2 has the width and depth larger in size than the diameter of the metal rod material 3. Therefore, the metal rod material 3 is completely contained and held in the molding groove 2, and the rolling roller 4 is directly pressed onto the mold surface 1*a*.

Figure 3B:
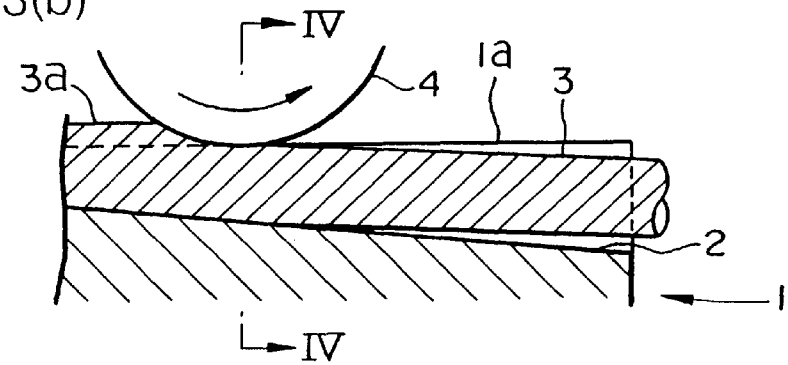
Figure 4B:
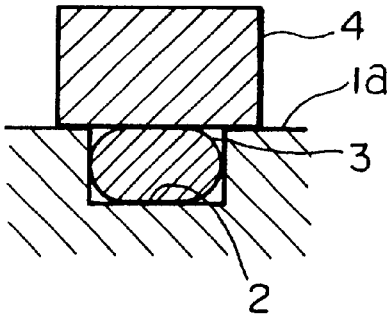

Moreover, in a middle portion of the molding groove 2 shown in FIGS. 3B and 4B, as the rolling roller 4 moves, the metal rod material 3 is pressed into the molding groove 2 having a gradually decreasing sectional area by the rolling roller 4. As a result, plastic deformation of the metal rod material 3 starts.

Figure 3C:
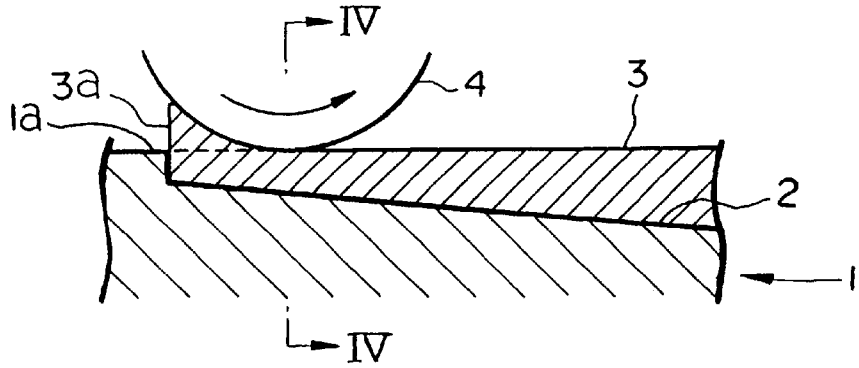
Figure 4C:
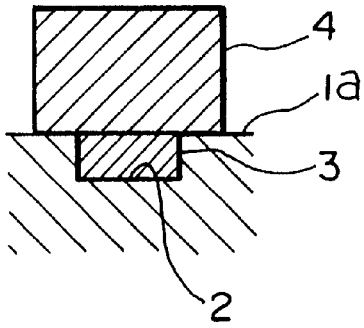

Furthermore, in the tip end 2*a* of the molding groove 2 shown in FIGS. 3C and 4C, the metal rod material 3 is pressed into the molding groove 2 having a sectional area smaller than that of the metal rod material 3 by the rolling roller 4. As a result, the metal rod material 3 is plastically deformed along the molding groove 2, and formed in a shape of the molding groove 2.

During the aforementioned treatment, the metal rod material 3 is completely contained in the molding groove 2 as described above in the rear end 2*b* of the molding groove 2, and plastically deformed along the molding groove 2 only on the tip end 2*a* side. Therefore, an excess material 3*a* of the metal rod material 3 flows toward the tip end 2*a*, the plastic processing can be performed without any difficulty, and a damage of the mold 1, particularly a damage of the molding groove 2 can be prevented.

Figure 3D:
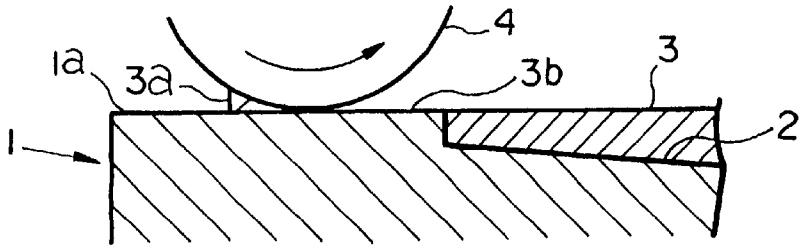

Moreover, as shown in FIGS. 3B and 3C, the excess material 3*a* of the metal rod material 3 overflowing from the molding groove 2 is extruded out of the molding groove 2 by the rolling roller 4. As a result, as shown in FIG. 3D, the excess material 3*a* is rolled between the mold 1 and the rolling roller 4, and an extremely thin foil-shaped burr 3*b* is formed.

In the first embodiment, when the rolling roller 4 rolls to a front part of the molding groove 2 as shown in FIG. 2, the roller moves onto the mold 1, and returns to a start position on the rear end 2*b* of the molding groove 2 as shown by arrows of FIG. 2. While the rolling roller 4 is on the mold 1, the completely plastically deformed metal rod material 3 is removed from the molding groove 2, and a new metal rod material 3 is contained in the molding groove 2. Moreover, when the aforementioned procedure is repeated, the plastic deformation of the metal rod material 3 can continuously be performed.

Figure 5:
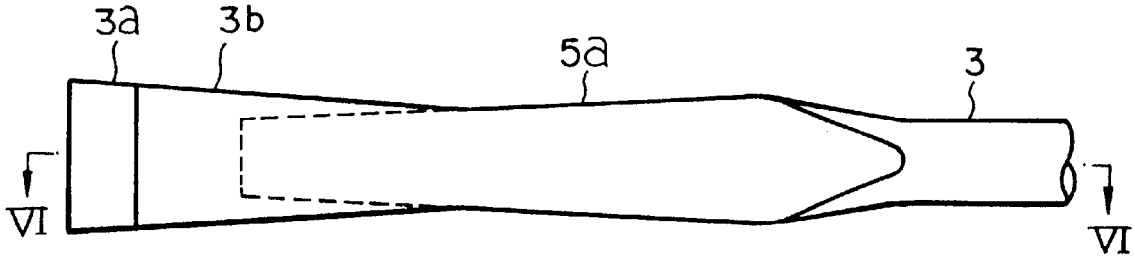
FIG. 5 is a plan view of a metal rod material obtained by the plastic processing method using the mold of FIG. 1.
Figure 6:
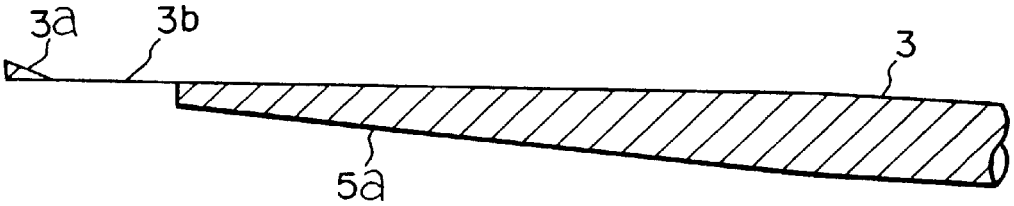
FIG. 6 is a sectional view taken along line VI—VI of FIG. 5.

As shown in FIGS. 5 and 6, the metal rod material 3 removed from the molding groove 2 has a flat and tapered tip end shape 5*a* in the tip end thereof. Moreover, in the tip end of the metal rod material 3, the burr 3*b* is integrally formed in a periphery of the tip end shape 5*a,* and a remaining non-rolled portion of the excess material 3*a* adheres to the tip end of the burr 3*b*.

Figure 7:
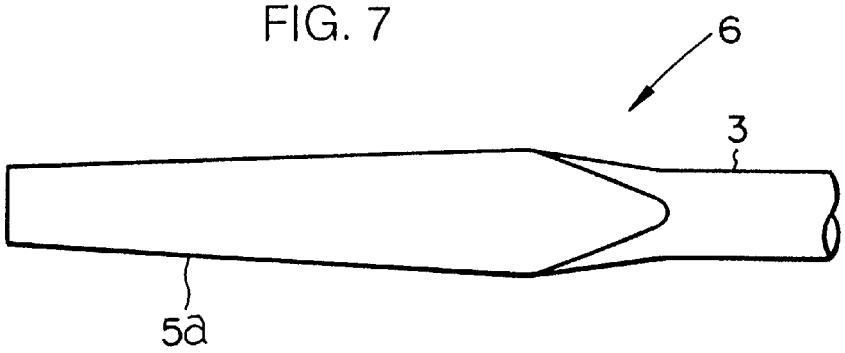
FIG. 7 is a plan view of the metal rod material obtained by the plastic processing method of the first embodiment.

Subsequently, the tip end of the metal rod material 3 shown in FIGS. 5 and 6 is subjected to barrel grinding, the burr 3*b* and excess material 3*a* are removed, the tip end of the metal rod material is chamfered, and a driver 6 is finally obtained as shown in FIG. 7.

Figure 8:
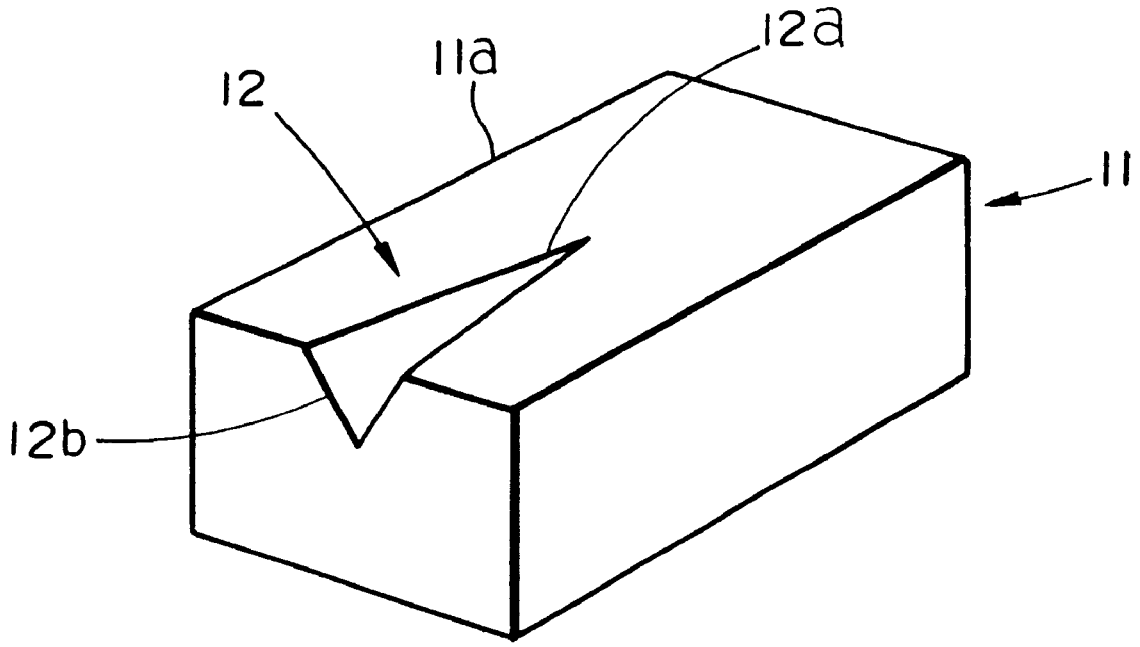
FIG. 8 is a perspective view of the mold for use in the plastic processing method according to a second embodiment of the present invention.

A second embodiment of the present invention will next be described. An object of the second embodiment is to mold a triangular drill. As shown in FIG. 8, a mold 11 for use in the second embodiment has a triangular pyramid molding groove 12 in a surface 11*a* of the mold. A sectional area of a tip end 12*a* of the molding groove 12 is smaller than the sectional area of the metal rod material 3, and a rear end 12*b* of the groove has a width and depth larger in size than the diameter of the metal rod material 3. Moreover, the molding groove 12 has a sectional area gradually decreasing toward the tip end 12*a* from the rear end 12*b* thereof.

Figure 9:
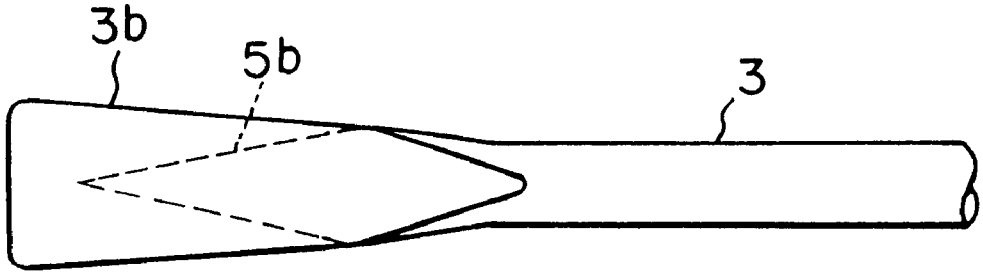
FIG. 9 is a perspective view of the metal rod material obtained by the plastic processing method of the second embodiment.
Figure 9:
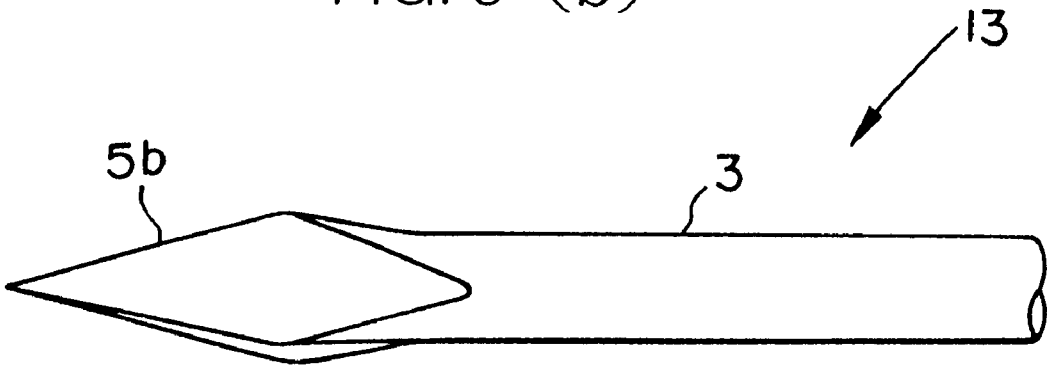

In the second embodiment, the metal rod material 3 is contained in the molding groove 12 (not shown), the same treatment as that of the first embodiment shown in FIG. 2 is performed, the tip end of the metal rod material 3 is plastically deformed along the molding groove 12, and the material is molded in accordance with the shape of the molding groove 12. As a result, the metal rod material 3 having a sharp triangular pyramid tip end shape 5*b* in the tip end thereof is obtained as shown in FIG. 9A. The remarkably thin foil-shaped burr 3*b* is integrally formed in the periphery of the tip end shape 5*b* in the tip end of the metal rod material 3.

Subsequently, the tip end of the metal rod material 3 shown in FIG. 9A is ground, the burr 3*b* is removed, a cutting edge is used, and a triangular drill 13 is finally obtained as shown in FIG. 9B. In order to sharpen the tip end shape 5*b* of the triangular drill 13 like the cutting edge, electrolytic grinding or chemical grinding is preferably performed to grind the drill.

In the aforementioned respective embodiments, the single rolling roller 4 is pressed and rolled on the mold surfaces 1*a,* 11*a*. Additionally, a rolling roller 14 constituted as shown in FIG. 10, or a rolling roller 16 constituted as shown in FIG. 11 may also be used.

Figure 10:
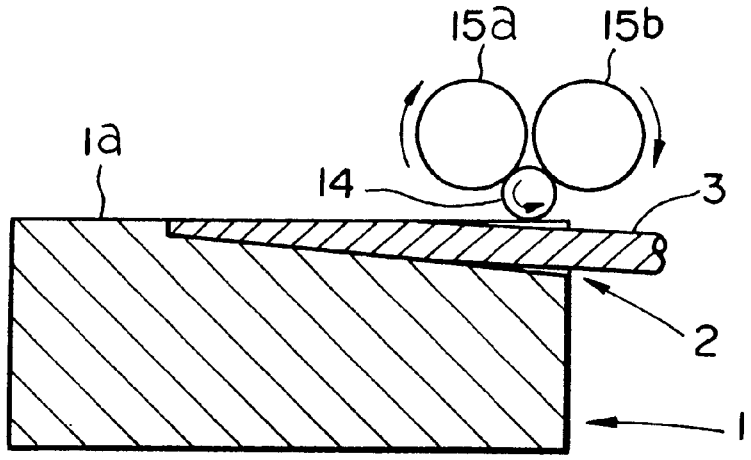
FIG. 10 is an explanatory sectional view showing a modification example of a rolling roller for use in the respective embodiments.
Figure 11:
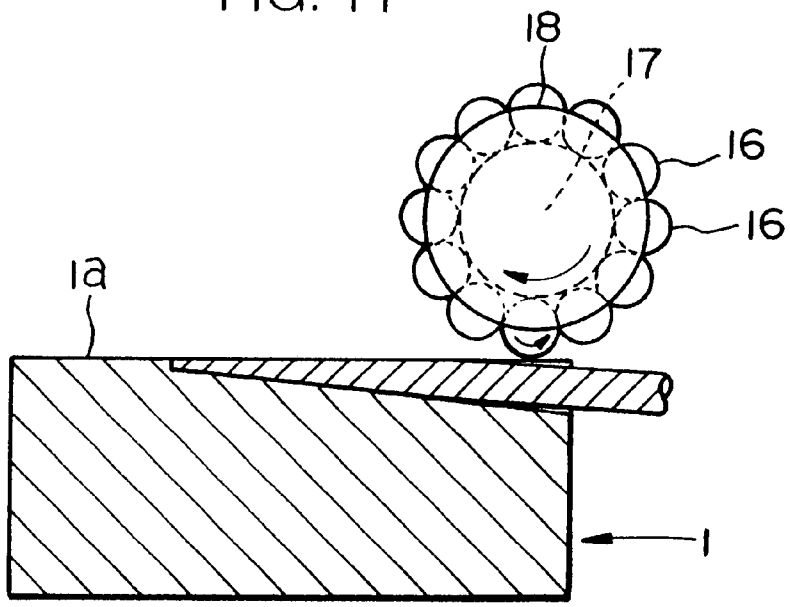
FIG. 11 is an explanatory sectional view showing another modification example of the rolling roller for use in the respective embodiments.
Figure 12:
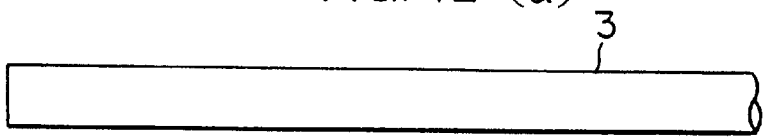
FIG. 12 is a perspective view showing one example of a conventional method for molding the metal rod material.
Figure 12:
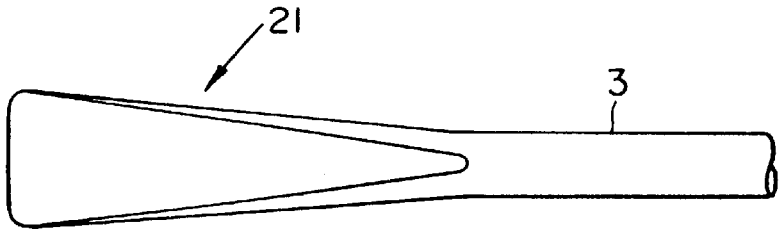
Figure 12:
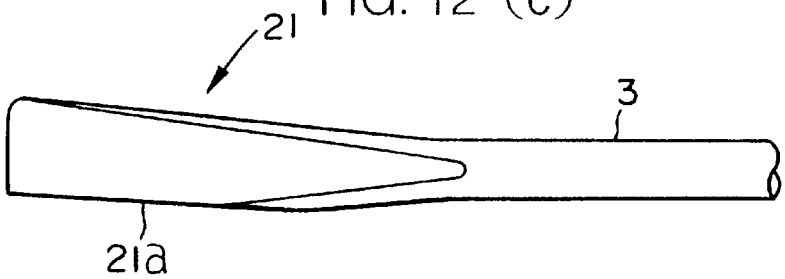
Figure 12:
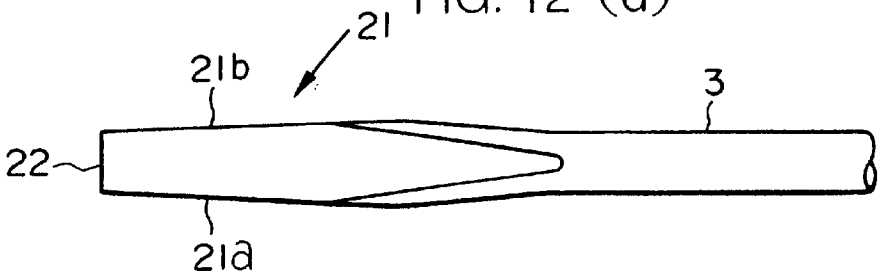
Figure 12:
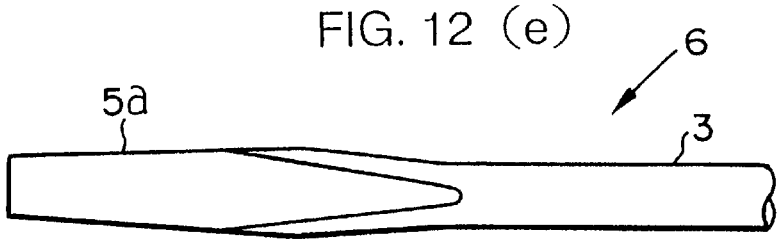
Figure 13:
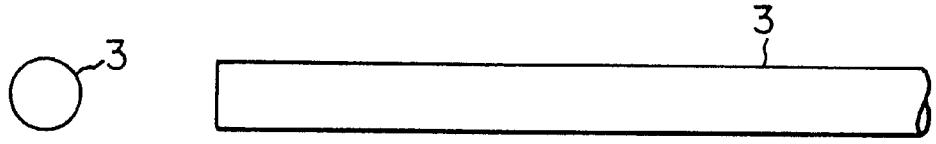
FIG. 13 shows a perspective view and front view showing another example of the conventional method for molding the metal rod material.
Figure 13:
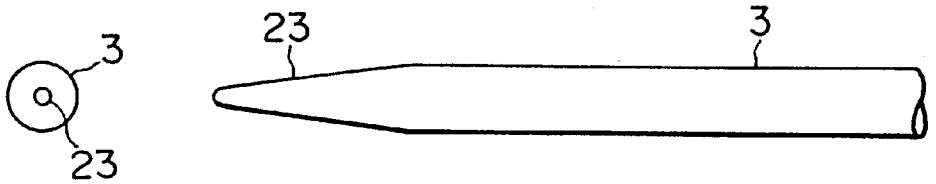
Figure 13:
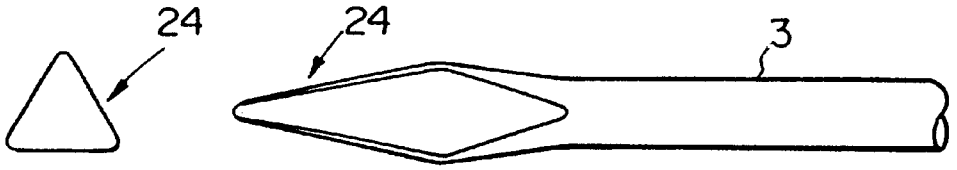
Figure 13:
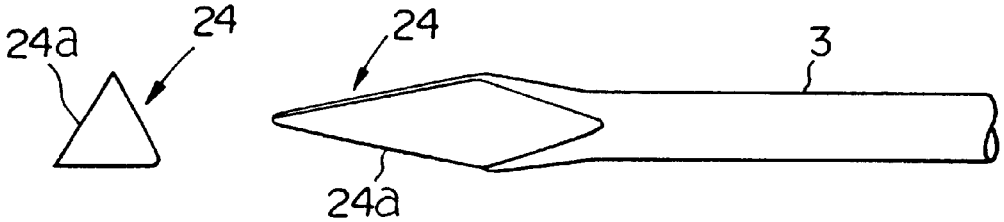
Figure 13:
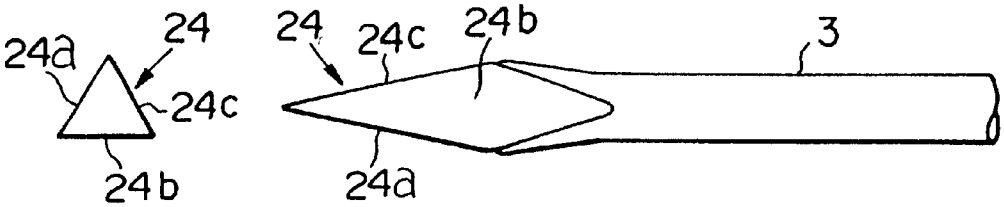
Figure 13:
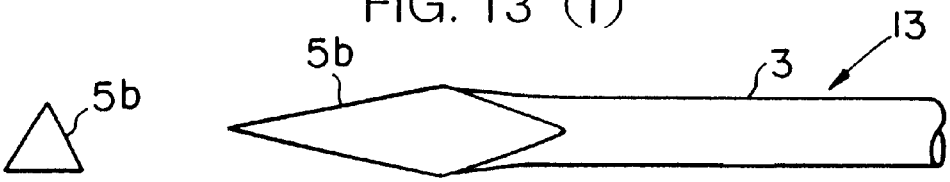

The rolling roller 14 shown in FIG. 10 contacts rollers 15*a,* 15*b* larger in diameter than the rolling roller 14, and is pressed in contact with the metal rod material 3 by the rollers 15*a,* 15*b*. Either one of the rollers 15*a,* 15*b* is a driving roller, the other roller is a driven roller, and the rollers rotate together by contact friction with the rolling roller 14. When the rolling roller 14 is pressed by the rollers 15*a,* 15*b,* the roller is protected by the large-diameter rollers 15*a,* 15*b,* and can be prevented from being damaged by the contact with the mold surfaces 1*a,* 11*a*.

Moreover, a plurality of rolling rollers 16 are supported in an annular groove (not shown) disposed along an outer periphery of a roller 17 by a retainer ring 18 disposed coaxially with the roller 17 larger in diameter than the rolling roller 16, and arranged in contact with the outer periphery of the roller 17 in a planetary shape. In the constitution shown in FIG. 11, the roller 17 serves as the driving roller, and the respective rolling rollers 16 rotate together by the contact friction with the roller 17. Similarly as the rolling roller 14 shown in FIG. 10, the rolling rollers 16 are protected by the large-diameter roller 17, and can be prevented from being damaged by the press contact with the mold surfaces 1*a,* 11*a*.

Additionally, the molding of the minus driver 6 and triangular drill 13 has been described in the aforementioned respective embodiments, but the plastic processing method of the present invention can be used in molding another shape as long as the tip end of the metal rod material 3 has a shape having a gradually decreasing sectional area.

What is claimed is:

1. A plastic processing method of a metal rod material, comprising the steps of:

containing the rod material in a molding groove which is disposed in a mold for molding the metal rod material and which has at least one end wherein a sectional area of said molding groove is smaller than a sectional area of the rod material along a longitudinal direction of the rod material;

pressing a rolling roller in contact with a mold surface having the molding groove, rolling/moving the rolling roller toward the end having the sectional area smaller than the sectional area of the rod material from the other end of the molding groove, and plastically deforming and molding the rod material along a shape of the molding groove by the rolling roller; and removing a burr formed of an excess material extruded out of the molding groove by the rolling roller during the plastic deformation.

2. The plastic processing method of the metal rod material according to claim 1, wherein the sectional area of said molding groove is smaller than the sectional area of the metal rod material on a tip-end side along the longitudinal direction of the metal rod material, said molding groove having a width and depth larger in size than a diameter of the rod material on a rear-end side, and wherein the sectional area of said molding groove gradually decreases toward the tip end of the molding groove on the tip-end side.

3. The plastic processing method of the metal rod material according to claim 1, wherein said rolling roller is rotated together with a roller having a diameter larger than a diameter of the rolling roller, and pressed in contact with said rod material by the large-diameter roller.

4. The plastic processing method of the metal rod material according to claim 1, wherein said rolling roller is rotated together with a roller having a diameter larger than a diameter of the rolling roller, and a plurality of rolling rollers are supported by a retainer ring disposed coaxially with the large-diameter roller in an outer periphery of the large-diameter roller, arranged in a planetary shape, and pressed in contact with said rod material by the large-diameter roller.

5. The plastic processing method of the metal rod material according to claim 1, further comprising the steps of removing said burr by barrel grinding, and chamfering a plastically deformed portion of said rod material.

6. The plastic processing method of the metal rod material according to claim 1, further comprising the steps of removing said burr by electrolytic grinding, and forming a cutting edge on a plastically deformed portion of said rod material.

7. The plastic processing method of the metal rod material according to claim 1, further comprising the steps of removing said burr by chemical grinding, and forming a cutting edge on a plastically deformed portion of said rod material.

* * * * *